US005139440A

United States Patent [19]

Volk et al.

[11] Patent Number: 5,139,440

[45] Date of Patent: Aug. 18, 1992

[54] ENVIRONMENTALLY SEALED INSULATION DISPLACEMENT CONNECTOR TERMINAL BLOCK

[75] Inventors: Thomas G. Volk, Grayslake; Ben Farb, Buffalo Grove, both of Ill.

[73] Assignee: Reliance Comm/Tec Corporation, Chicago, Ill.

[21] Appl. No.: 721,257

[22] Filed: Jun. 26, 1991

[51] Int. Cl.[5] ..... H01R 4/24

[52] U.S. Cl. ..... 439/413; 439/402; 439/912

[58] Field of Search ..... 439/271, 391–407, 439/409–413, 417–419, 912

[56] References Cited

U.S. PATENT DOCUMENTS

| | | | |
|---|---|---|---|
| 4,157,208 | 6/1979 | Roberts | 439/410 |
| 4,159,159 | 6/1979 | Kaucic et al. | 399/198 H |
| 4,637,675 | 1/1987 | Loose | 399/97 R |
| 4,705,340 | 11/1987 | Loose | 439/395 |
| 4,734,061 | 3/1988 | Randall, Jr. et al. | 439/271 |
| 4,764,125 | 8/1988 | Deboratoli | 439/403 |
| 4,795,364 | 1/1989 | Frantum, Jr. et al. | 439/407 |
| 4,826,449 | 5/1989 | Debortoli et al. | 439/411 |
| 4,846,721 | 7/1989 | Debruycker et al. | 439/411 |
| 4,864,725 | 9/1989 | Debbaut | 29/871 |
| 4,883,431 | 11/1989 | Uken et al. | 439/521 |
| 4,911,655 | 3/1990 | Pinyan et al. | 439/412 |
| 4,917,633 | 4/1990 | Lacoste | 439/402 |
| 4,971,573 | 11/1990 | Pinyan | 439/412 |
| 5,041,012 | 8/1991 | Caprio | 439/409 |

*Primary Examiner*—David L. Pirlot

*Attorney, Agent, or Firm*—Trexler, Bushnell, Giangiorgi & Blackstone, Ltd.

[57] ABSTRACT

An environmentally sealed terminal block includes a hollow block member and a plurality of connection assemblies mountable on the block member for providing interconnections between respective conductors of two groups of wires. Each of the connection assemblies includes an insulation displacement connector for receiving at least one conductor of each of the two groups of wires, a cap mountable to the block for accepting a quantity of sealing material for surroundingly engaging and environmentally sealing the insulation displacement connector and having a through aperture. A conductive activating screw extends through the through aperture and has a head portion projecting outwardly of the cap when assembled therewith to provide a test point. A nonconductive head cap member surroundingly engages the head of the activating screw and has an opening for access to the test point, the head cap member engaging the cap member for coupling the screw therewith, and the screw being freely rotatable relative to the head cap member and to the cap member. A conductive plate electrically interconnects the activating screw and the insulation displacement connector; and a resealable cap seal is coupled with the nonconductive head cap member for covering the opening therein, and is selectively openable and reclosable for permitting selective access to the test point.

17 Claims, 4 Drawing Sheets

100
106
112
110
112
108
104
102
68
70
54
52
24
3
50
40
48
46
44
42
3
56
62
64
32
32a
32b
32c
10
28
28
24
26
30
24
24
34
20
18
22
35
37
16
84
76
12
14
33

116
100
106
112
112
114
108
110
104
102
74
72
54
70
53
52
24
50
40
48
46
43
44
56
62
64
36
38
32b
32a
32c
82
10
10a
30
30a
34
10b
10d
37
16
33
14
12
35
84a
78
76
86
84
80
92
94
90

ENVIRONMENTALLY SEALED INSULATION DISPLACEMENT CONNECTOR TERMINAL BLOCK

BACKGROUND OF THE INVENTION

This invention relates to terminal blocks and more particularly to terminal blocks which use insulation displacement connectors (IDCs) and are environmentally sealed.

Terminal blocks are used in the telephone industry to provide a connection between the tip and ring conductors of one group of telephone wire pairs and the tip and ring conductors of another group of telephone wire pairs. The blocks are often installed in equipment such as pedestals and aerial splice closures which are used outdoors. Therefore, such blocks may be exposed to environmental conditions such as high humidity and heavy rain which can lead to corrosion of both the terminals provided in the block to make the connection as well as the connections themselves.

Corrosion of the telephone wire connections interferes with service to the telephone company subscribers. Such interference may take many forms depending on the extent of the corrosion. For example, the corrosion may give rise to excessive noise on the telephone line or loss of signal strength. No matter what form the interference takes, if it results from corrosion of the wire connections at the block, it will require the cleaning of the connections and of the terminals of the block. The telephone operating company must then send a craftsperson to the site where the terminal block is located to do the cleaning. If the terminal block site is in a corrosion promoting location, e.g., near the seashore, that may lead to frequent visits to the site by the craftsperson to clean the connections.

To avoid the above subscriber service problems and the expense of sending a craftsperson to clean the connections, it may be desirable that terminal blocks provide connections which are environmentally sealed. In addition to being environmentally sealed, the terminal blocks should also be capable of retrofit installation in existing equipment, such as pedestals and aerial closures, where blocks which are not environmentally sealed are now used. The environmentally sealed blocks should have the capability of providing the same number of total connections as the non-environmentally sealed blocks provided. In other words, the environmentally sealed blocks should be a direct replacement for the non-environmentally sealed blocks.

Environmental sealing can be provided by using any one of a number of different types of reenterable encapsulants such as a grease or a gel. It is desirable that the environmentally sealed terminal block be designed so that it is capable of using either grease and/or some other encapsulant such as a gel. It is further desirable that if grease is used either in whole or in part as the encapsulant that the block include means to retain the grease adjacent the terminals or other connection means and the connections even if the connection means and/or connections have to be accessed by a craftsperson.

OBJECTS AND SUMMARY OF THE INVENTION

Accordingly, it is a general object of the present invention to provide an environmentally sealed insulation displacement connector terminal block.

Briefly, and in accordance with the foregoing object, an environmentally sealed terminal block comprising a hollow block member; and a plurality of connection means mountable on said block member for providing interconnections between respective conductors of two groups of wires, each of said connection means comprising an insulation displacement connector having termination means for receiving at least one conductor of each of said two groups of wires, a cap mountable to said block for accepting a quantity of sealing material for surroundingly engaging and environmentally sealing said insulation displacement connector and having a through aperture; conductive activating screw means extending through said through aperture and having a head portion projecting outwardly of said cap when assembled therewith to provide a test point; a nonconductive head cap member for surroundingly engaging the head of said screw means and having an opening for access to said test point, said head cap member engaging said cap member for coupling said screw means therewith, said screw means being freely rotatable relative to said head cap member and to said cap member; conductive plate means for electrically interconnecting said activating screw means and said insulation displacement connector; and a resealable cap seal coupled with said nonconductive head cap member for covering said opening therein, and selectively openable and reclosable for permitting selective access to said test point.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
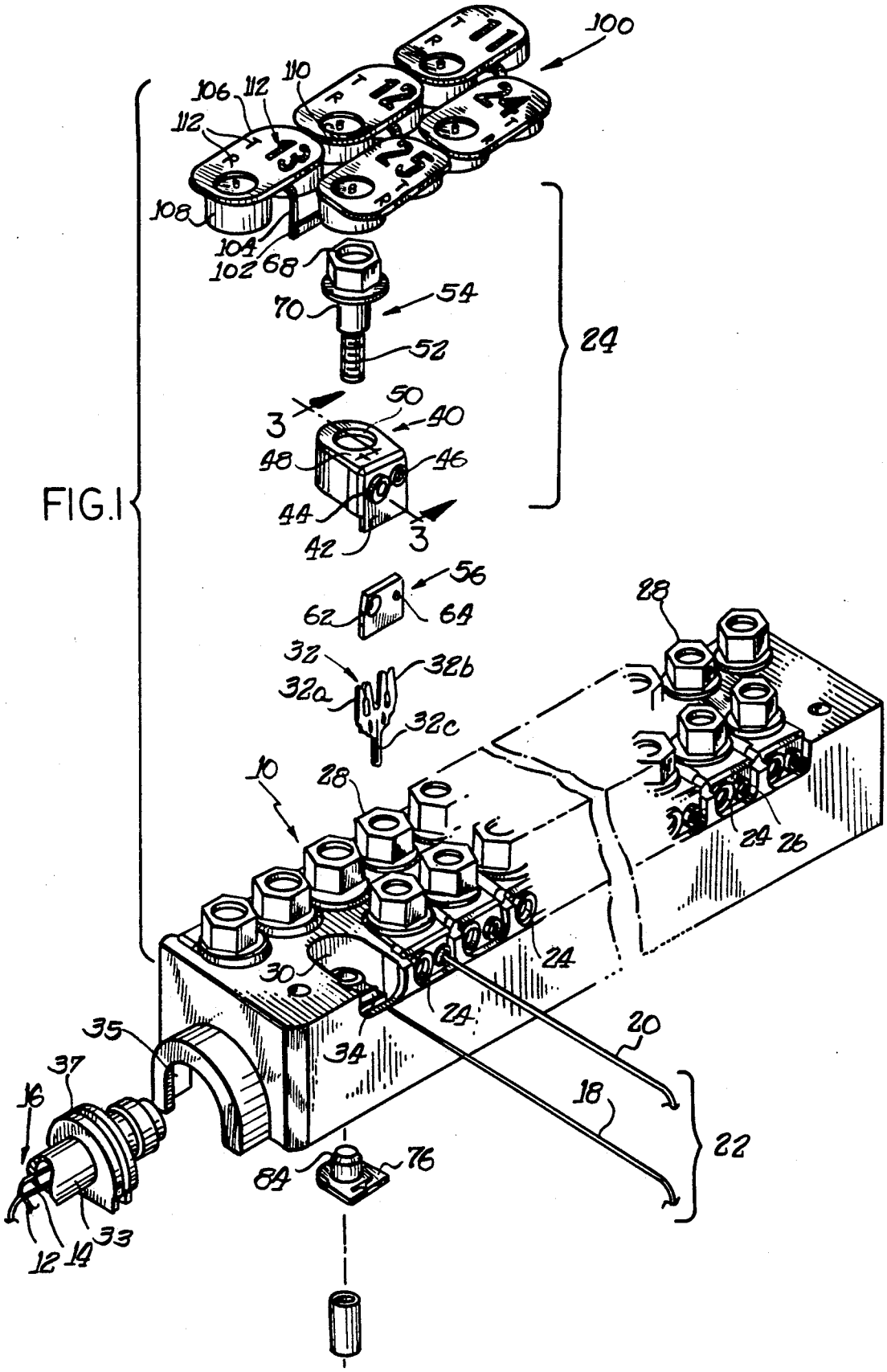
FIG. 1 is a perspective view, partially in exploded form, of an environmentally sealed insulation displacement connector terminal block in accordance with the present invention.

Referring now to FIG. 1 there is shown a perspective view of one embodiment of a terminal block 10 in accordance with the present invention. Block 10 allows respective tip and ring conductors, e.g. 12, 14 of a first group 16 of telephone wire pairs to be interconnected with corresponding tip and ring conductors e.g., 18, 20, of a second group 22 of telephone wire pairs. Solely for purposes of explanation, block 10 is shown in FIG. 1 as having the capability to interconnect fifty tip and ring conductors of a first group 16 of twenty-five telephone wire pairs to the fifty tip and ring conductors of a second group 22 of telephone wire pairs. The first and second groups of telephone wire pairs are not fully shown in FIG. 1.

In order to provide the interconnection between the tip and ring conductors of the two telephone wire pair groups, block 10 includes fifty identical terminal assemblies or connection means 24 which are arranged in a first row 26 of twenty-four connection means and a parallel second row 28 of twenty-six connection means. The twenty-four connection means 24 of row 26 provide the capability to interconnect two groups of twelve telephone wire pairs, while the twenty-six connection means 24 of row 28 provide the capability to interconnect two groups of thirteen telephone wire pairs. Therefore, the fifty connection means 24 provide the capability to interconnect the two groups 16, 22 of twenty-five telephone wire pairs.

Figure 2:
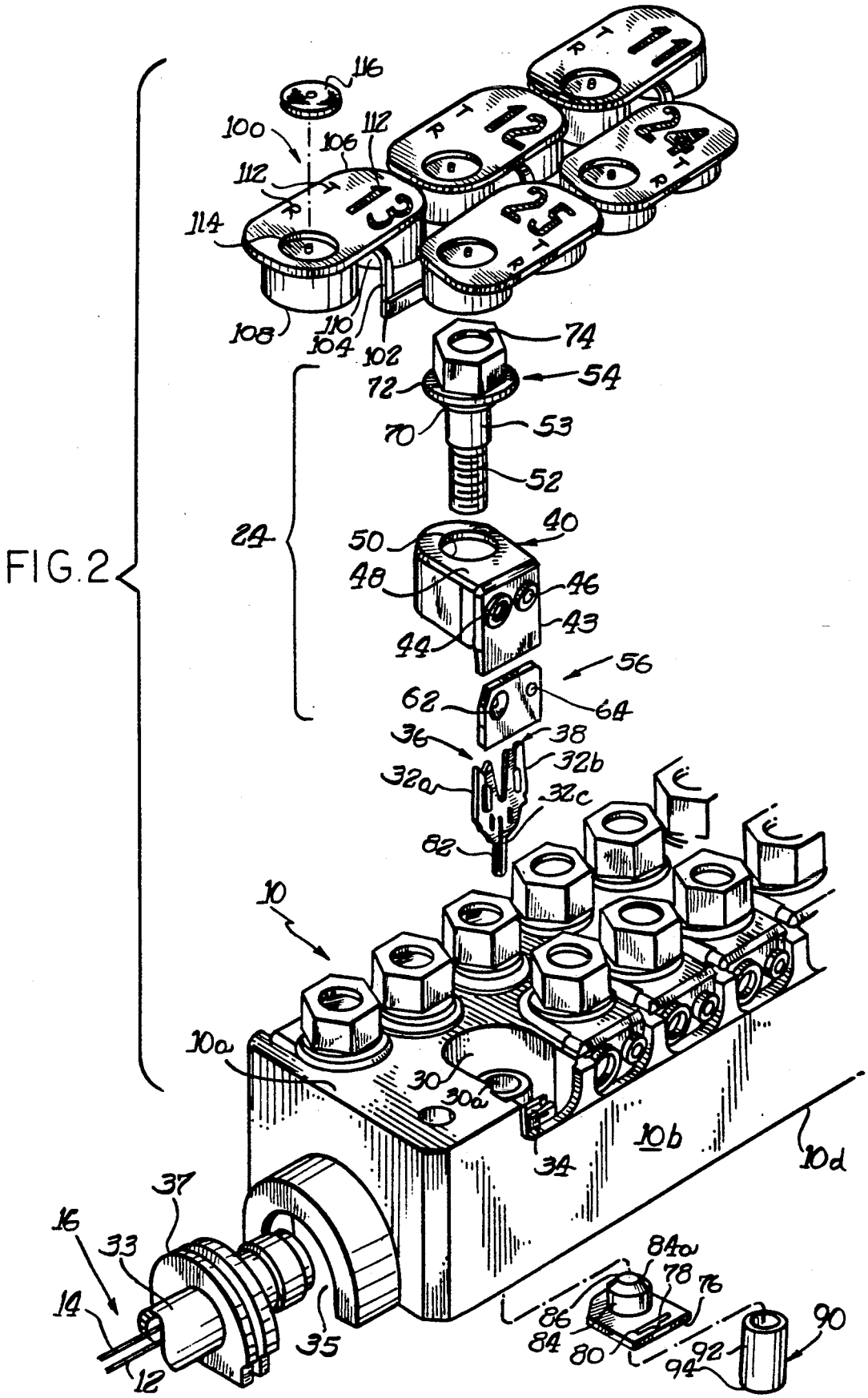
FIG. 2 is an enlarged, partial view of the terminal block, including the exploded perspective portion thereof, of FIG. 1.

An endmost terminal assembly 24 of row 26 is shown in exploded perspective in FIG. 1. An enlargement of that exploded perspective and the associated part of block 10 is shown in FIG. 2. As can be seen, block 10 includes a generally U-shaped cavity 30 for each of the connection means. The cavity 30 projects downwardly from front 10*a* of block 10. A portion of the wall of block side 10*b* is removed in forming a similar cavity for each of the connection means in row 26, while a portion of the wall of block side 10*c* is removed in forming a similar cavity for each of the connection means in row 28. The reason for removing a portion of the wall in sides 10*b*, 10*c* in forming each cavity will become apparent when the operation of connection means 24 is described.

Each of connection means 24 includes an insulation displacement connector (IDC) means 32 which comprises first and second two beam IDC clips (also known as quick clips) 32*a* and 32*b*, respectively. Quick clips are designed to make an electrical connection with an insulated wire inserted between the two beams of the clip without shearing the wire. By including first and second IDC clips 32*a*, 32*b* in IDC means 32, terminal assembly 24 is capable of providing a cross-connection between wire 12 of the first group 16 of telephone wire pairs and wire 18 of the second group 22 of telephone wire pairs. Preferably, however, the first and second clips 32*a* and 32*b* are designed for use with different gauges of telephone wire such that the wires of the second group 22 may be any of several different gauges of wire. In the illustrated embodiment, IDC clip 32*a* is designed for use with 18½ gauge drop wire while IDC clip 32*b* is designed for use with 22 or 24 gauge wire.

IDC means 32 also includes wire wrap terminal 32*c*. The conductors 12, 14 and associated group of wires 16 preferably enter the block 10 as a cable stub 33 at a stub-receiving opening 35 which is sealed by a seal The conductor 12 of first group 16 of telephone wire pairs can be connected to the wire wrap terminals 32*c*. The connection to the conductor 18 of the second group 22 of telephone wire pairs can then be established through either of clip 32*a* or clip 32*b* of IDC means 32. Cavity 30 includes a slot 34 in its base for receiving IDC means 32. When IDC means 32 is seated in slot 34 of cavity 30, wire receiving open ends 36, 38 of IDC clips 20*a*, 20*b*, respectively project upwardly towards front 10*a* of block 10, while wire wrap terminal 20*c* projects downwardly towards a rear side 10*d* of block 10. The group of wires 16 of cable stub 33 are preferably central office or distribution cable pairs, while the group of wires 22 are preferably subscriber line pairs.

Connection means 24 further includes a cap 40 which has an exterior side surface of a shape complementary to the shape of the interior side surface of cavity 30. The cap 40 is preferably of a height similar to the depth of cavity 30, and its shape is such that it provides a tight fit with cavity 30 to retain sealant therein. A rectangular front face 42 of cap 40 which includes circular apertures 44 and 46 through which the insulated telephone wire is inserted to access IDC clip 32, and a downwardly depending lip 43. As can be seen from FIG. 2, the diameter of circular aperture 44 is larger than the diameter of circular aperture 46. In the embodiment for block 10 being described the diameter of aperture 44 is sufficient to permit no larger than 18½ AWG gauge insulated drop wire to be inserted, while the diameter of aperture 46 is sufficient to permit either 22 or 24 AWG gauge insulated wire to be inserted.

A top face 48 of cap 40 includes non-centered circular aperture 50 which is large enough to freely accept a shank 52 of a screw or activating screw means 54 when connection means 24 is assembled. A grommet 56 is seated inside of cap 40 parallel to front face 42 when connection means 24 is assembled. Cap 40 activating screw means 54 and grommet 56 form a subassembly when connection means 24 is assembled.

Figure 3:
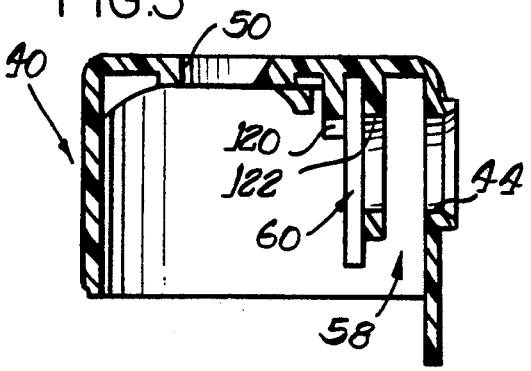
FIG. 3 is a partial sectional view of a cap portion of the terminal block of FIGS. 1 and 2 taken generally along the line 3—3 of FIG. 2.

As best viewed in FIG. 3, cap 40 includes a first internal cavity 58 which is parallel to and just to the inside of front face 42 for receiving grommet 56. Cap 40 also includes a second internal cavity 60 which is parallel to the first cavity 58 and closer to aperture 50 for receiving IDC clips 32*a* and 32*b*. Grommet 56 lies behind apertures 44 and 46, respectively when the grommet is inserted into the cap. The apertures are sized to permit the entry into the interior of cap 40 of the wire gauges associated with apertures 44 and 46. The grommet 56 has areas of reduced thickness which line up with apertures 44 and 46. When a wire is pushed through one of apertures 44 or 46, it punctures the grommet 56, which thereby seals the point of wire entry.

Figure 4:
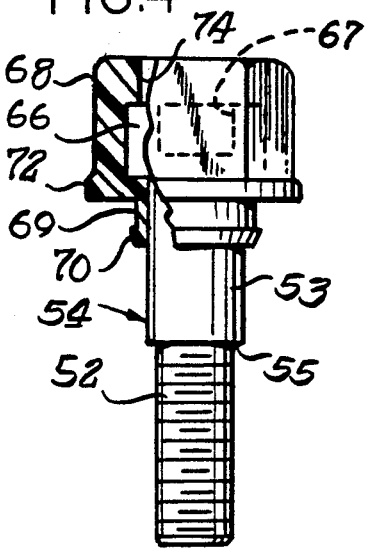
FIG. 4 is a sectional view taken through an activating screw member of the assembly of FIGS. 1 and 2.

As best viewed in FIG. 4, a first shank portion 52 of activating screw means 54 is threaded; preferably, shank 52 is provided with a double helix thread. A second shank portion 53 is unthreaded end of somewhat larger diameter, such that a radial edge or annular shoulder is formed where shank portions 52 and 53 meet. The screw 54 has a hexagonal head 66 over which a hexagonal nonconductive or plastic head cap 68 is molded. An internal hex recess 67 is formed in head 66 to receive a mating tool for rotating the screw 54 during initial manufacturing and assembly of the terminal block. In the field, the screw 54 is preferably driven by engagement of a suitable tool with the external hex surface of head cap 68.

Head cap 68 has a reduced diameter axial extension 69 which terminates in a first radially projecting frustoconical edge 70. The diameter of edge 70 is just slightly greater than the diameter of circular aperture 50 of cap 40. Head cap 68 has a second radially projecting circular edge 72 which is above edge 70. The top of the hexagonal head cap 68 includes a circular opening 74 which permits access to the hexagonal recess 67 of the screw 54 which serves as a test point when the connection means 24 is used to connect two telephone wires together.

When connection means or mechanism 24 is assembled, activating screw means 54 is pressed into aperture 50. Edge 70 is forced through the aperture 50 in cap 40 and retains the activating screw means 54 in the cap 40. The space between edges 70 and 72 is just slightly greater than the thickness of cap 40 about the aperture 50 and is just sufficient to allow activating screw means 54 to rotate freely when it is assembled with the cap 40 without a substantial amount of side to side and up and down movements.

The bottom of cavity 30 also includes circular, noncentered aperture 30*a* alignable with aperture 50 in cap 40. The diameter of aperture 30*a* is large enough to accept therethrough the shank 52 of activating screw means 54 for rotation freely.

The center to center dimension in rows 26 and 28 between respective adjacent between connection means 24 is set by telephone operating company specifications. Off centering apertures 50 and 30*a* allows a plurality (fifty, in the illustrated embodiment) of connection means 24 to be accommodated in a block 10 whose overall length is short enough that the block may still be retrofitted in currently installed equipment wherein such blocks are used, for example, in pedestals, building entrance and aerial installations.

Figure 6:
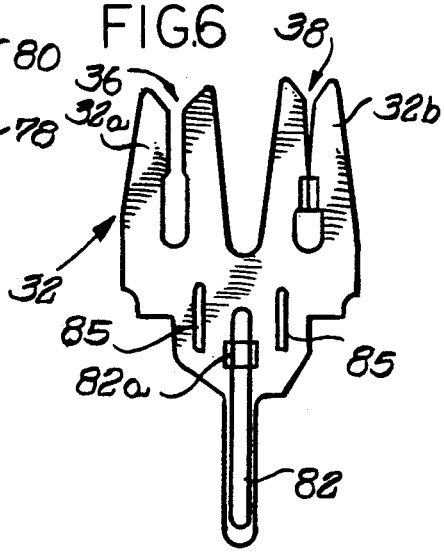
FIGS. 6 and 7 are respective front and side elevations of an insulation displacement connector member of the assembly of FIGS. 1 and 2.
Figure 7:
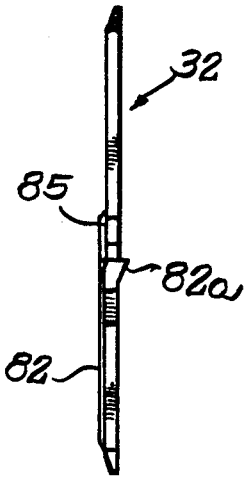

Connection means 24 also includes a conductive nut plate 76 which has slot or aperture 78 for receiving the wire wrap terminal 32*c* of IDC means 32 when the connection means 24 is assembled. Slot 78 has an indentation 80 in its center edge (See also FIG. 5). As also shown in FIGS. 6 and 7, IDC means 32 includes a raised, embossed tab portion 82 which cooperates with indention 80 to position and projection 82*a* to secure the IDC means 32 in the nut plate slot 78 and thereby form a subassembly when the connection means is assembled. IDC means 32 also has outwardly projecting embossed ribs 85 which also engage plate 76 at aperture or slot 78 to establish an electrical connection between the IDC means 32 and the nut plate 76.

Figure 5:
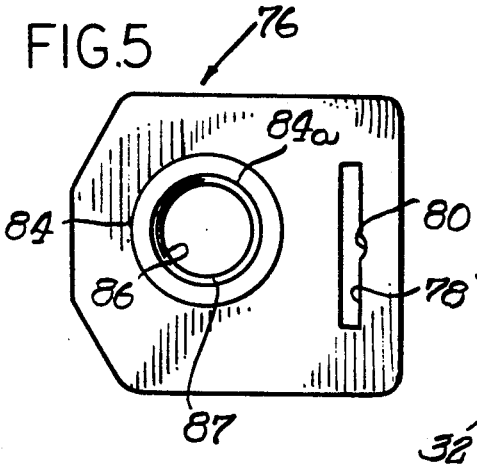
FIG. 5 is a top plan view of a nut plate member of the assembly of FIGS. 1 and 2.

As also shown in FIG. 5, nut plate 76 also has essentially cylindrical projection 84. A top portion 84*a* of projection 84 is tapered inwardly to allow the nut plate to be press fit into the aperture 30*a* in the block 10. Projection 84 has a through opening 86 which is threaded complementary to the threads of conductive shank 52 of activating screw means 54 for receiving the shank as the connection means 24 is being assembled. A radial undercut 87 at the top of opening 86 assures that shoulder 55 will bottom out or engage projection 84 in a metal-to-metal contact when screw 54 in fully advanced relative to projection 84. Thus, all external forces applied to screw 54 are carried by metal parts of the assembly. Therefore, when connection means 24 is assembled an electrical path is established between IDC means 32, activating screw means 54 and nut plate 76. The head 66 of screw 54 then serves as a test point for the telephone wire or wires attached to IDC means 32.

Connection means 24 further includes a nonconductive or plastic cylindrical sleeve 90. The sleeve 90 has an open end 92 and closed end 94. The open end 92 allows the sleeve to be slid over the projecting shank 52 of screw 54 after the shank has been threaded into and through projection 84 and its thread staked to prevent revomal. The sleeve is retained on shank 54 by the friction or prevailing torque between the metal screw threads and the inside of the plastic sleeve. Upon the final assembly of block 10, the rear 10*d* of the block will be filled by a potting compound which environmentally seals the rear. Sleeve 90 serves to keep the potting compound away from the threads of the screw 54 and the complementary threads on the inside of projection 84, and also protects the stub conductors from shorting out against the thread.

Each of the connection means 24 of block 10 will be environmentally sealed using a suitable reenterable encapsulant such as grease. The encapsulant will be used in the interior of cap 40 to environmentally seal the IDC means 32 and any telephone wires connected thereto. Encapsulant will also be introduced through the opening 74 of nonconductive head 68 to environmentally seal the test point.

Figure 8:
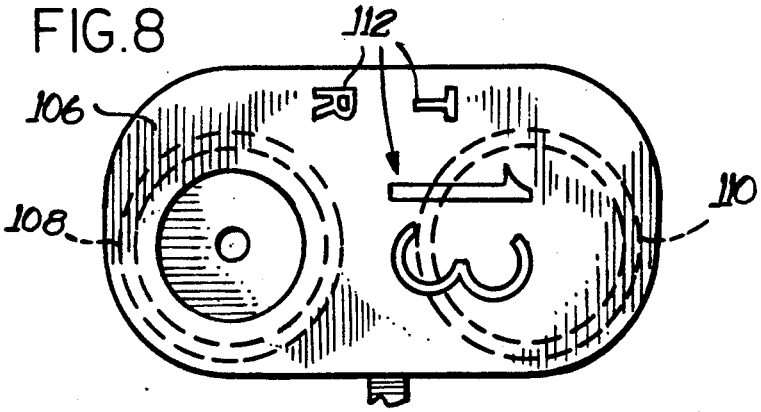
FIG. 8 is an enlarged partial view of the snap-cap seal assembly of FIGS. 1 and 2.

The opening 70 is closed by a snap cap seal 100 which comprises one-half of a dual cap member which is in turn joined to a multiple cap strip 102 by a flexible connector member or strap 104. As also shown in FIG. 8, snap cap seal 100 has a base portion 106 and a pair of downwardly projecting cylindrical skirts 108, 110. The internal surface of each projecting skirt 108, 110 is such that it surroundingly engages an outer surface of head cap 68 and extends toward circular edge 72. Preferably, the skirts 108, 110 are arranged for engaging head caps of two adjacent side-by-side assemblies 24. A top surface of the base 106 may have suitable indicia 112 for each of the twenty-five line pairs to be connected at block 10 as well as tip (T) and ring (R) indicia for each pair. An additional circular recess 114 may be provided to accept a marker disc 116 for designating special circuits. Preferably, a plurality of such snap cap seal 100 project oppositely from elongate connecting or carrier strip 102, which is hinged to permit, together with flexible connectors 104, individual caps to be opened or closed as desired, relative to corresponding headcaps 68 to either side of strip 102.

The preferred manner of assembly of connection means 24 will now be described. A first subassembly consisting of nut plate 76 and IDC means 32, and a second subassembly consisting of cap 40 (filled with encapsulant), activating screw means 54 and grommet 56 are each assembled and then are brought into assembled relationship with each other. The assembly of the nut plate and IDC means subassembly takes place in the block 10. The assembly of the encapsulant-filled cap, activating screw means and grommet subassembly takes place externally to the block.

The assembly of the nut plate and IDC means subassembly takes place as follows. Nut plate 76 is pressed into the rear 10*b* of block 10 with projection 84 extending into the bottom of circular aperture 30*a* and slot 78 aligned with slot 34. IDC means 32 is then inserted in slot 34 with wire wrap terminal 32*c* pointing towards the rear of block 10. The IDC means 32 is advanced in the slot 34 until leading edges of clips 32*a* and 32*b* abut the material adjacent the slot 34. At that point tab 82A will have engaged with indentation 80 and ribs 85 with slot 78 to thereby mechanically secure and electrically couple the IDC means to the nut plate.

The assembly of the cap 40, activating screw means 54 and grommet 56 subassembly will now be described. Grommet 56 is inserted in the associated internal cavity 58 of cap 40. Activating screw means 54 is then brought into assembled relationship with cap 40 by inserting screw shank 52 into opening 50 and pressing down until edge 70 snaps through and edge 72 comes into contact with top surface 48. Encapsulant is introduced then into the remaining interior volume of cap 40. The subassembly comprising cap, activating screw means and grommet can then be brought into assembled relationship with the subassembly comprising the IDC means and the nut plate which are now in place in the block 10. Shank 52 projects out of the bottom of cap 40. The shank 52 is inserted in circular aperture 30 *a* and is aligned with opening 86. The cap internal cavity 60 is aligned with the IDC clips 32*a*, 32*b*.

Screw 54 is then rotated clockwise and the threads on shank 52 engage the internal complementary threads of nut plate 76 thereby causing the cap subassembly to move downwardly in cavity 30. Screw 54 is rotated clockwise using a suitable tool, such as an allen-type wrench to engage socket 67, or the standard 216 tool used in the telephone industry to engage the exterior of head cap 68, until the shoulder 55 on the screw bottoms out on the projection 84 of the nut plate. An endmost thread portion of the shank 52 is upset or staked to prevent removal. The sleeve is slid onto the shank. The central office or distribution cable stub has its individual conductors terminated at the respective wire wrap posts 32*c* of the IDC clips 32. Thereupon, and all of the connections are tested at the test points 74 in the heads of the screws 54. If all of the connections test satisfactory, the cable stub is sealed to the block 10 at seal 37 and the hollow interior of the block 10 is potted. Encapsulant is put into the test point and snap cap seal 100 is snapped into place over opening 74. The encapsulation of the test point can alternatively take place during the assembly of the cap, screw and grommet subassembly.

Figure 10:
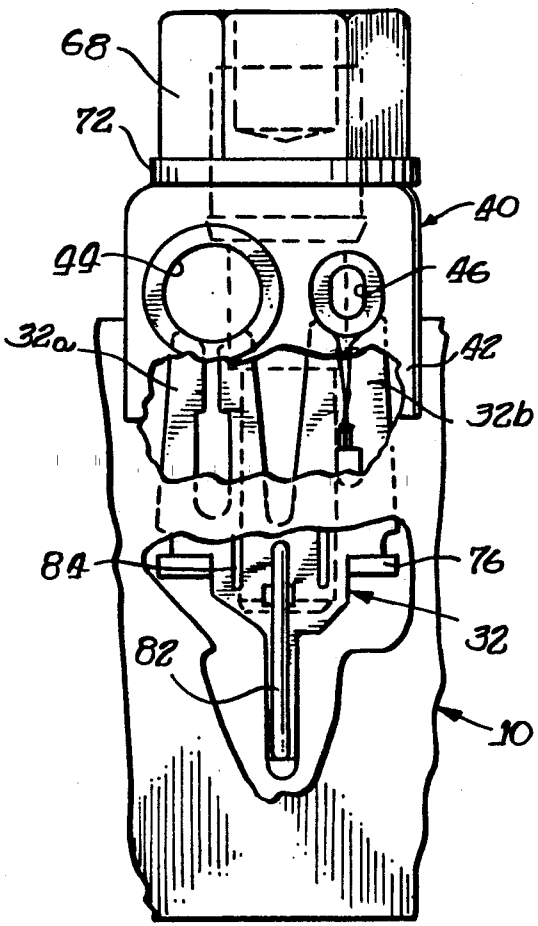
FIG. 10 is a partial front elevation, partially broken away, showing a moved position of the wire connection means of FIG. 9.
Figure 9:
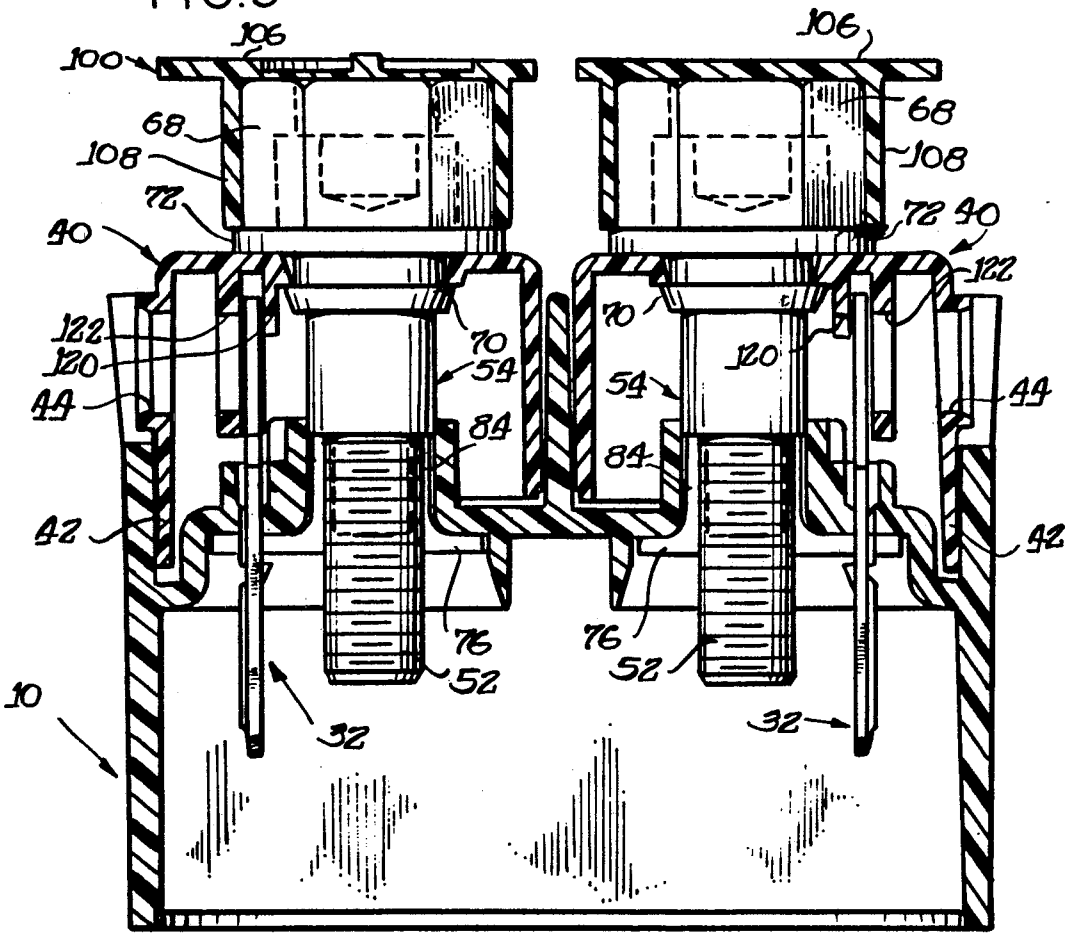
FIG. 9 is a partially assembled sectional view of one wire connection means of the terminal block of FIG. 1.

The operation of connection means 24 to provide a connection between the tip or ring conductor of a telephone wire pair of a first group of telephone wire pairs to the corresponding tip or ring conductor of a telephone wire pair of a second group of telephone wire pairs will now be described. Reference is also invited to FIGS. 9 and 10 in this regard. For purposes of this description it is assumed that the conductor 12 of the first group 16 of telephone wire pairs is connected to the wire wrap terminal 32*c* of IDC means 32. To establish the connection between conductor 12 and the conductor 18 of the second group 22 of telephone wire pairs the second conductor 18 must be inserted into the interior of cap 40. Depending on the gauge of the second conductor, it will be inserted through one of circular apertures 44 and 46.

In order to insert the second conductor, the cap 40 must be raised so that the apertures 44 and 46 are above the open ends of IDC clips 32*a* and 32*b*. Cap 40 is raised by rotating screw 54 counterclockwise. As the screw is so rotated, skirt 43 prevents a gap between the bottom edge of cap face 42 and the cavity 30 to prevent loss of the sealant. The upset threads at the bottom of screw shank 52 prevent the shank from being disengaged from projection 84 of nut plate 76. This occurs with cap 40 fully raised, that is, to the position shown in FIG. 10. The conductor 18 can now be fully inserted into the interior of the cap through the associated one of circular apertures 44 or 46, puncturing grommet-seal 56.

The cap 40 is then lowered to bring the conductor 18 into contact with the associated one of IDC means 32*a* or 32*b* by rotating screw 54 clockwise. As best viewed in FIG. 9, this causes internal wall 120 and an aligned upper edge of an internal aperture 122 of cap 40 to press the wire into engagement with one or both of clips 32*a*, 32*b*. Surprisingly, we have found that satisfactory wire termination takes place with only on the order of one inch pound of torque applied to screw 54. This establishes the connection between the conductor 14 of the first group 16 and the conductor 18 of the second group 22. That connection is environmentally sealed by the encapsulant in the interior of cap 40 and the covering provided by cap 40 to the cavity 30 and IDC means 32 when the connection is completed.

Should it be necessary to change or repair a connection after it has been made, screw 54 is rotated in the counterclockwise direction to raise cap 40. In this case, a lower edge of aperture 122 presses the conductor 18 out of the IDC clip 32*a* or 32*b*. The conductor 18 can then be removed from the interior of cap 40 through aperture 44 or 46. Grommet 56 provides a wiping action to ensure that little or no encapsulant is removed from the interior of cap 40 when the conductor 18 is removed from the interior of the cap.

Connection means 24 may also be used to provide a cross connection between a conductor of a first group of telephone wire pairs and a conductor of a second group of telephone wire pairs. In providing such a cross connection, neither conductor is connected to wire wrap terminal 32*c*. Instead the cross connection is provided by using both of the circular apertures 44 and 46 and both of the IDC clips 32*a* and 32*b*. While the apertures are shown in FIGS. 1, 2 and 10 as having two different diameters in order to accommodate, as described above, several different gauges for the conductor, the apertures would typically have the same diameter if connection means 24 were to be used to provide a cross connection. The IDC clips 32*a* and 32*b* could be changed such that one accommodates 18½ and the other 22/24 AWG wire or both accommodate 22/24 AWG wire.

The cross connection is established by first raising cap 40 in the manner described above. The conductors of the first and second group are then fully inserted into the interior of cap 40 through the associated apertures 44 and 46. The cap is then lowered in the manner described above so as to bring the conductors into contact with the IDC clips 32*a* and 32*b* to thereby establish an electrical connection between the two conductors through the IDC means 32. The cross connection can be changed or repaired by raising the cap in the manner described above so as to remove the conductors from the IDC clips. The conductors can then be removed from the interior of cap 40 through the associated apertures 44 and 46.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. An environmentally sealed terminal block comprising a hollow block member; and a plurality of connection means mountable on said block member for providing interconnections between respective conductors of two groups of wires, each of said connection means comprising:

an insulation displacement connector having termination means for receiving at least one conductor of each of said two groups of wires;

a cap mountable to said block for accepting a quantity of sealing material for surroundingly engaging and environmentally sealing said insulation displacement connector and having a through aperture;

conductive activating screw means extending through said through aperture and having a head portion projecting outwardly of said cap when assembled therewith to provide a test point;

a nonconductive head cap member for surroundingly engaging the head of said screw means and having an opening for access to said test point, said head cap member engaging said cap for coupling said screw means therewith, said screw means being freely rotatable relative to said head cap member and to said cap;

conductive plate means for electrically interconnecting said activating screw means and said insulation displacement connector; and a resealable cap seal coupled with said nonconductive head cap member for covering said opening therein, and selectively openable and reclosable for permitting selective access to said test point.

2. An environmentally sealed terminal block according to claim 1 wherein said through aperture of said cap is non-centered with respect to said cap.

3. An environmentally sealed terminal block according to claim 1 and further including a nonconductive sleeve member surroundingly engaging a portion of said screw member which is located within said hollow block member upon assembly therewith.

4. An environmentally sealed terminal block according to claim 1 wherein said conductive plate means includes a cylindrical, internally-threaded, nut-like projection for engagement with said screw means, and a plate-like portion extending outwardly of said projection and having a through aperture for electrical and mechanical engagement with said insulation displacement connector.

5. An environmentally sealed terminal block according to claim 1 wherein said cap includes a pair of through apertures for receiving at least one wire therethrough for connection with said insulation displacement connector and further including a grommet seated inside of said cap and aligned with said cap through apertures for sealingly engaging said at least one wire passing therethrough.

6. An environmentally sealed terminal block according to claim 1, wherein said activating screw means and said conductive plate means have cooperating assembly means for defining an assembled condition of said connection means relative to said block and respective fully advanced and fully retracted positions of said activating screw means for respectively engaging and disengaging at least one wire relative to said insulation displacement connector, said assembly means engaging in metal to metal contact to define a stop in said fully advanced position, such that external forces applied to said screw means are carried by said conductive screw means and said plate means.

7. An environmentally sealed terminal block according to claim 1 wherein said insulation displacement connector comprises first and second insulation displacement clips projecting from a common base.

8. An environmentally sealed terminal block according to claim 7 wherein said first and second clips are sized for engaging different gauges of wire.

9. An environmentally sealed terminal block according to claim 8 wherein said cap includes a pair of through apertures for receiving at least one wire therethrough for connection with said insulation displacement connector and further including a grommet seated inside of said cap and aligned with said cap through apertures for sealingly engaging said at least one wire passing therethrough, and wherein the through apertures in said cap are in alignment with the respective insulation displacement clips and correspondingly sized for accepting different gauges of wire therethrough.

10. An environmentally sealed terminal block according to claim 8 wherein said insulation displacement connector further includes a wire-wrap post projecting oppositely from said insulation displacement clips and into said hollow block member.

11. An environmentally sealed terminal block according to claim 1 and further including a cap seal assembly incorporating said cap seal of each of a plurality of said connection assemblies and comprising a snap cap seal having a base portion and a pair of similar downwardly depending skirts, each for surroundingly engaging one of said nonconductive head cap members of a pair of adjacent ones of said connection assemblies.

12. An environmentally seal terminal block according to claim 11 wherein said cap seal assembly further includes an elongate connecting strip for interconnecting a plurality of similar said snap cap seals and flexible connector means for coupling each said snap cap seals to said elongate connecting strip.

13. An environmentally sealed terminal block according to claim 12 wherein said elongate connecting strip further defines hinge means for hingedly connecting oppositely projecting ones of said snap cap seals for engagement with head cap members of said terminal block located to either side of said elongate connecting strip.

14. A connection assembly for environmentally sealing an interconnection between two wire conductors, and for interfitting with an environmentally sealed terminal block assembly, said connection assembly comprising:

an insulation displacement connector having termination means for receiving at least one conductor of each of said two groups of wires, a cap mountable to said block for accepting a quantity of sealing material for surroundingly engaging and environmentally sealing said insulation displacement connector and having a through aperture;

conductive activating screw means extending through said through aperture and having a head portion projecting outwardly of said cap when assembled therewith to provide a test point;

a nonconductive head cap member for surroundingly engaging the head of said screw means and having an opening for access to said test point, said head cap member engaging said cap member for coupling said screw means therewith, said screw means being freely rotatable relative to said head cap member and to said cap member;

a resealable cap seal coupled with said nonconductive head cap member for covering said opening therein, and selectively openable and reclosable for permitting selective access to said test point.

15. A connection assembly according to claim 14 wherein said resealable cap seal comprises a portion of a cap seal assembly, said cap seal assembly comprising a plurality of similar cap seals each including a snap cap seal having a base portion and a pair of similar downwardly depending skirts, each of said skirts being configured for surroundingly engaging one nonconductive head cap member of a pair of adjacently located ones of said head cap members.

16. A connection assembly according to claim 15 wherein said cap seal assembly further includes an elongate connecting strip for interconnecting a plurality of similar said snap cap seals and flexible connector means for coupling each said snap cap seal to said elongate connecting strip.

17. A connection assembly according to claim 16 wherein said elongate connecting strip defines hinge means for hingedly connecting a plurality of said snap cap seals projecting to opposite sides thereof.

* * * * *

UNITED STATES PATENT AND TRADEMARK OFFICE

CERTIFICATE OF CORRECTION

PATENT NO. : 5,139,440

DATED : August 18, 1992

INVENTOR(S) : Thomas G. Volk, Ben Farb

It is certified that error appears in the above-identified patent and that said Letters Patent is hereby corrected as shown below:

Column 3, Line 63 "sealed by a seal" should read
— sealed by a seal arrangement 37. —

Column 4, Line 4 "20a, 20b," should read —32a, 32b,—

Column 4, Line 5 "20c projects" should read — 32c projects —

Signed and Sealed this

Twenty-eighth Day of September, 1993

*Attest:*

*Attesting Officer*

BRUCE LEHMAN

*Commissioner of Patents and Trademarks*